United States Patent [19]

Spindelboeck et al.

[11] Patent Number: 4,723,596

[45] Date of Patent: Feb. 9, 1988

[54] EXPANSION-, DEAERATION AND RESERVOIR TANK FOR THE LIQUID-COOLING SYSTEM OF INTERNAL COMBUSTION ENGINES

[75] Inventors: Dieter Spindelboeck, Pfaffenhofen; Erwin Schweiger, Dachau, both of Fed. Rep. of Germany

[73] Assignee: Bayerische Motoren Werke A.G., Munich, Fed. Rep. of Germany

[21] Appl. No.: 762,678

[22] Filed: Aug. 5, 1985

[30] Foreign Application Priority Data

Aug. 16, 1984 [DE] Fed. Rep. of Germany ..... 3430115

[51] Int. Cl.[4] ..... F28D 15/00; F01P 11/02

[52] U.S. Cl. ..... 165/104.32; 123/41.54; 123/41.51

[58] Field of Search ..... 165/104.32; 123/41.54, 123/41.27, 41.51; 220/22, 1 V

[56] References Cited

U.S. PATENT DOCUMENTS 4,130,159 12/1978 Ohta et al. ..... 165/104.32
4,231,424 11/1980 Moranne ..... 165/104.32
4,457,362 7/1984 Cadars ..... 165/104.32
4,463,802 8/1984 Villeval ..... 165/104.32

FOREIGN PATENT DOCUMENTS 8015573 9/1980 Fed. Rep. of Germany .

*Primary Examiner*—Albert W. Davis, Jr.
*Attorney, Agent, or Firm*—Barnes & Thornburg

[57] ABSTRACT

A volume expansion, venting and reservoir tank for the liquid-cooling system of internal combustion engines with two chambers connected by means of an overflow line, which are formed from plastic molded parts welded together. The overflow line as well as further connections and openings are molded integrally with the molded parts at a filler inlet. The tank is constructed favorable from a manufacturing point of view and is applicable alternatively to different cooling systems for different pressure control possibilities of the two chambers depending on the arrangement of one closure cover or two closure covers with pressure control valves at the two chambers.

13 Claims, 4 Drawing Figures

EXPANSION-, DEAERATION AND RESERVOIR TANK FOR THE LIQUID-COOLING SYSTEM OF INTERNAL COMBUSTION ENGINES

The present invention relates to an expansion, deaeration and reservoir tank for the liquid cooling system of internal combustion engines with two chambers separated by a partition wall.

In a known tank of this type of construction according to the DE-OS No. 28 52 725, the filler inlet, the overflow line, pipe connections for vent lines and fill-in lines as well as connecting openings in a further partition wall which additionally subdivides a chamber, cannot be rationally manufactured in one piece as plastic integrally molded parts with the two plastic molded parts for the two chambers and the first partition wall. Therebeyond, this container or tank is provided and applicable exclusively for cooling systems in which all chambers of the container or tank have the same pressure.

It is known from the DE-OS No. 30 45 357 to so series-connect two chambers in separate containers or tanks by means of valves arranged in a respective closure cover by way of an overflow line that either only the first is under excess pressure and the second under atmospheric pressure or both chambers may be under excess pressure. A suggestion for a structurally rational combination of both containers or tanks cannot be found in this disclosure.

It is the object of the present invention to so construct a tank or container of the known type that—apart from the parts which have to be detachably attached for operating reasons, such as closure cover or lid with valves, refill cover or lid and level pick-up switch—all structural parts, connections and openings can be integrally molded with the molded parts forming the two chambers, and that one or two closure covers with valves can be coordinated thereby to one or both chambers in order to control within the same the pressure build-up, as required, in a known manner.

The underlying problems are solved in a first embodiment according to the present invention in that the partition wall subdivides the chambers approximately horizontally and includes an opening which connects an upper fill-in opening with the first lower chamber by way of a filler inlet that is formed-on or molded integrally with the second upper chamber, in that the overflow line which is molded integrally with the filler inlet, terminates, on the one hand, in an outer enlarged section of the filler inlet adapted to be sealed off by a closure cover and adapted to be molded in the upward direction and, on the other hand, in the bottom area of the second chamber, and in that the connections and the further openings for a further closure cover, for a fill-in cover, for the atmospheric pressure equalization and/or for a level switch are integrally molded with the chambers and/or the filler inlet. Owing to the horizontal separation of the two chambers, to the filler inlet to the lower chamber which extends through the upper chamber in the vertical molding direction and to the overflow line to the bottom area of the upper chamber, a two-chamber container or tank is created together with the integral molding of further structural parts to the thus-molded parts forming the chambers, which can be rationally manufactured from three one-piece plastic molded parts and can be applied in a versatile manner.

According to a second embodiment, the underlying problems are solved according to the present invention in that the first chamber is constructed as filler inlet, in that the filler inlet includes an upper, outwardly disposed enlarged section which forms the fill-in opening, is adapted to be sealed off by a closure cover and is adapted to be molded in the upward direction, in that the fill-in opening connects with the lower connection to the cooling medium pump and together with the second chamber is adapted to be molded in a first mold in the direction toward the lower horizontal separating plane, in that the overflow line which is integrally molded with the filler inlet, terminates, on the one hand, in the upper section of the filler inlet and, on the other, in the bottom area of the second chamber, in that a second molded bottom part is connected with the inlet filler and with the second chamber in the separating plane and closes the same, and in that the connections and the further openings for a further closure cover, for a fill-in cover, for the atmospheric pressure equalization and/or for a level switch are integrally molded with the two molded parts. This second embodiment includes only two molded parts, whereby one chamber is formed by the filler inlet alone. An even smaller structural expenditure is made possible therewith. According to a further feature of the present invention, the filler inlet of the second embodiment continues in the molded bottom part in an integrally molded connecting nipple with approximately the same or smaller cross section, which enlarges the filler inlet in the downward direction as a first chamber, respectively, forms the connection to the cooling medium pump. If the filler inlet together with the overflow line forms a separate plastic molded part and is secured in an upwardly disposed opening of the second chamber, then it becomes possible without significant additional expenditures to realize the separate molding of the filler inlet with the overflow line and the fastening thereof in an upwardly disposed opening of the second chamber.

The container or tank according to the present invention may be so constructed in its external dimensions, in the arrangement of its connections and of its fastening elements which can also be integrally molded, that it is simply interchangeable for commercially available single chamber tanks for improving the function of the cooling system in internal combustion engines which are already in use. Furthermore, the container or tank may be structurally combined in a known manner with a radiator tank and one of the molded parts of the tank may thereby be integrally molded in one piece with a radiator tank.

These and other objects, features and advantages of the present invention will become more apparent from the following description when taken in connection with the accompanying drawing which shows, for purposes of illustration only, two embodiments in accordance with the present invention, and wherein.

Figure 1:
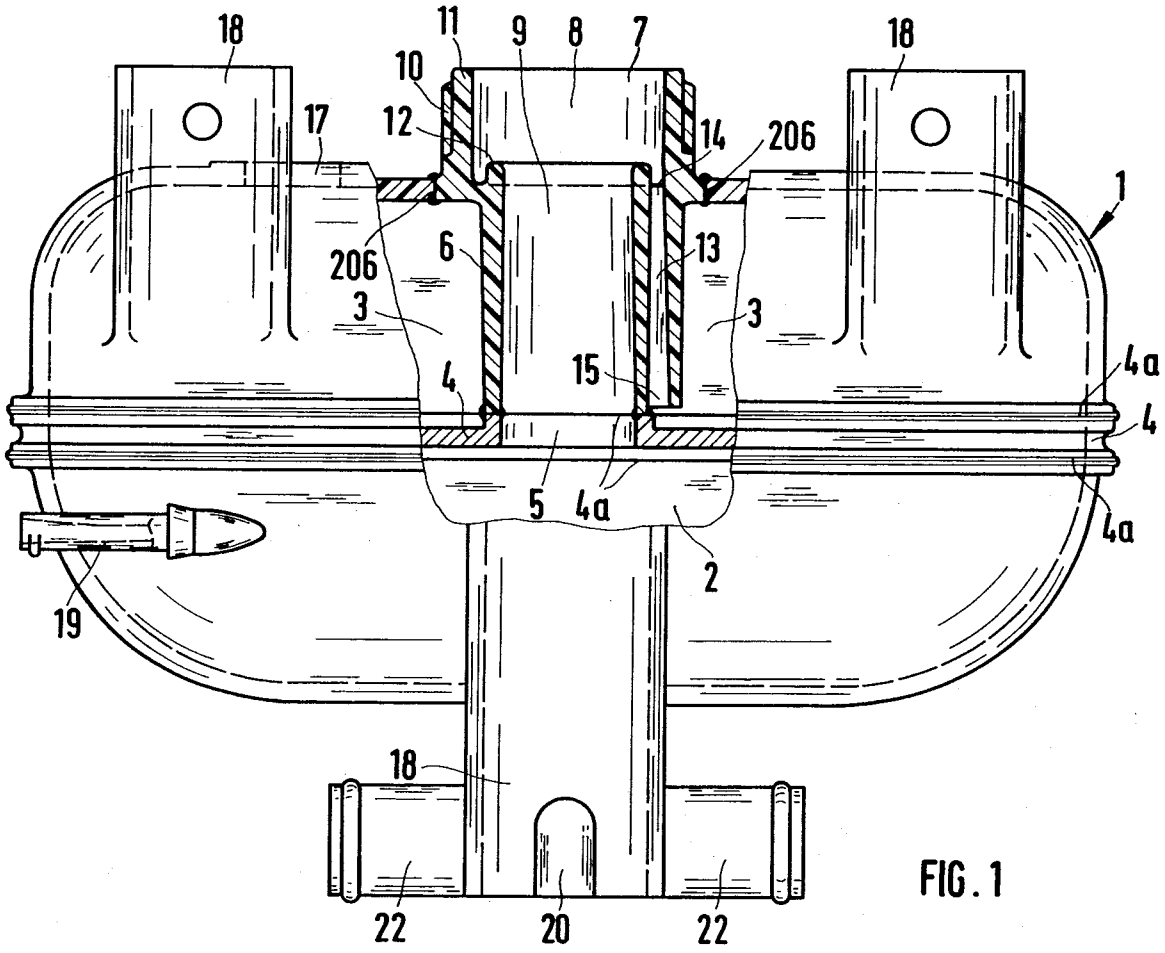
FIG. 1 is an elevational view, partly in cross section, of a volume expansion-, venting and reservoir tank in accordance with the present invention for the cooling system of internal combustion engines, taken along line I—I of FIG. 2.
Figure 2:
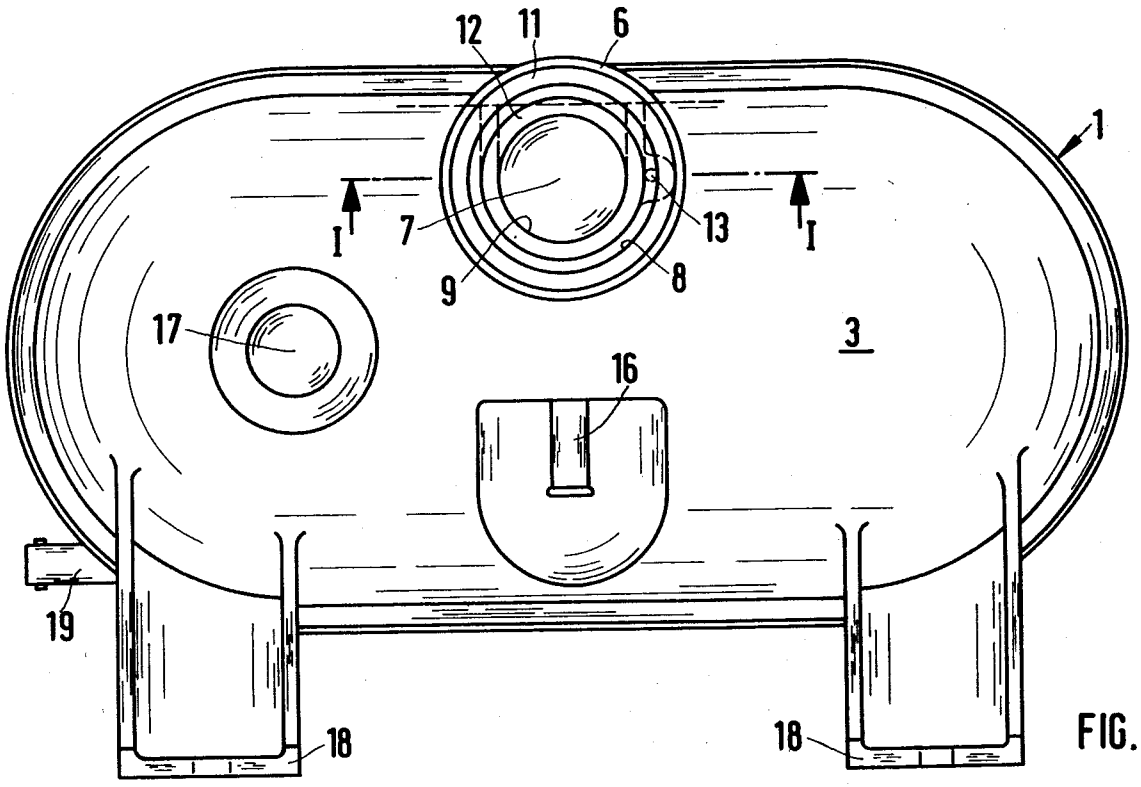
FIG. 2 is a plan view on the tank of FIG. 1.
Figure 3:
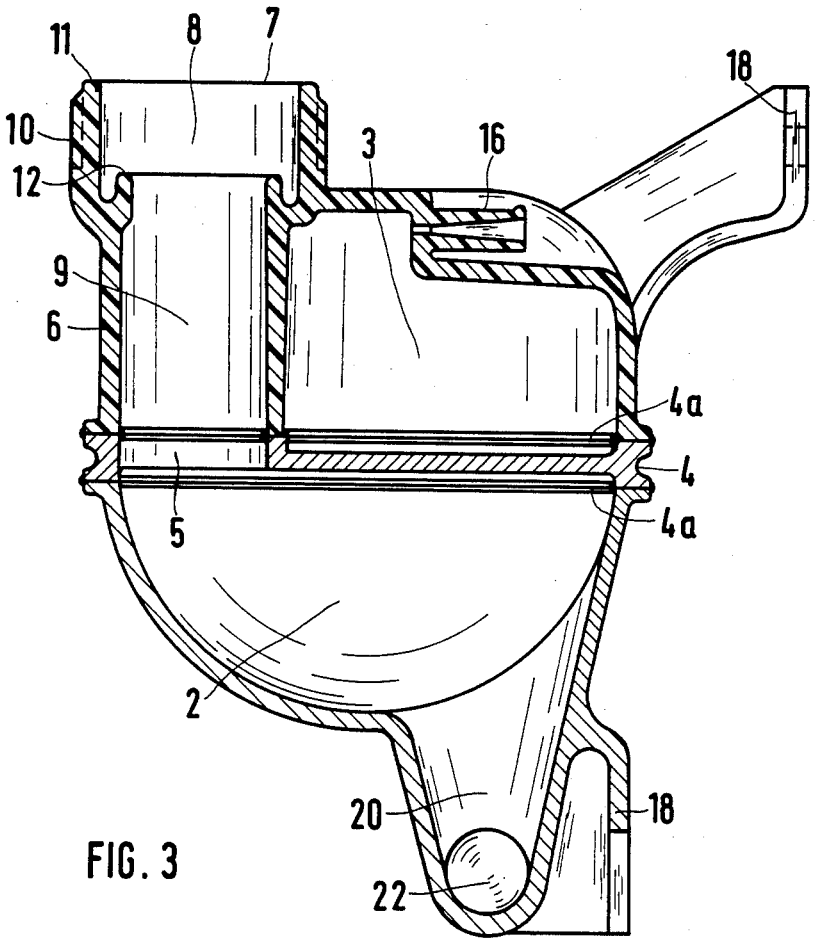
FIG. 3 is a transverse cross-sectional view through the tank of FIGS. 1 and 2.

Referring now to the drawing wherein like reference numerals are used throughout the various views to designate like parts, and more particularly to FIGS. 1 to 3, a container or tank for the volume changes conditioned by temperature and pressure changes of the cooling medium in the cooling system of internal combustion engines, for the venting of the cooling system and for a supply for the compensation of cooling medium losses due to leakage places and discharge by way of excess pressure valves consists of three one-piece plastic molded parts, namely, of a first lower chamber 2, of a second upper chamber 3 and of a partition wall 4. These parts are nondetachably connected with each other into a unitary container or tank in two partition planes 4*a* by welding, gluing or the like. The partition wall 4 is arranged horizontally in the installed condition of the tank 1 and includes an opening 5, through which the lower chamber 2 is connected with the fill-in opening 7 of the filler inlet 6 by way of the filler inlet 6 formed-on or molded integrally with the upper chamber 3 inwardly and at the top outwardly thereof and is sealed off with respect to the interior of the upper chamber 3. The fill-in opening 7 is arranged in an outer section 8 of the filler inlet 6, which compared to the inner section 9 has an enlarged interior cross section as well as an external thread 10, an upper sealing surface 11, and an inner sealing surface 12, delimiting the lower section, for a closure cover of commercially available type (not shown) which contains excess pressure and vacuum valves.

An overflow line 13 is integrally molded with the inner section 9 of the filler inlet 6 at its outside arranged in the upper chamber 3; the overflow line 13 extends from an upper discharge 14 in the outer section radially outside of the sealing surface 12 to a lower discharge 15 into the bottom area of the upper chamber 3 barely above the partition wall 4.

Furthermore, a hose-connecting nipple 16 (FIG. 2) is integrally molded with the upper chamber 3 at a high point thereof, which serves for the connection of a hose for an atmospheric pressure-regulating or vent line and for a cooling medium overflow out of the upper chamber 3. Moreover, a further opening 17 for a fill-in cover, for a level pick-up switch and/or a further closure cover containing additional valves is integrally molded with the upper side of the upper chamber 3. Furthermore, the upper chamber 3 includes fastening flanges 18 for retaining the tank or container which are integrally molded with an external longitudinal side.

A hose-connecting nipple 19 for the connection of the end of a vent line from a high point of the cooling system as well as one hose connecting nipple 21 and 22 each for the return from a heating system, respectively, for a fill-in and return line to the suction side of a cooling medium pump which are arranged coaxially to one another at a recessed lower bulged portion 20 (FIG. 3) and a further fastening flange 18 are integrally molded with the lower chamber 2 laterally thereof.

A small structural expenditure with low weight and low costs is attained for a container or tank constructed in a relatively complicated manner by the construction of the three plastic molded parts for the two chambers 2 and 3 and the partition wall 4 inclusive the respectively integrally molded structural parts, which can be each made in one piece in a favorable manner from a manufacturing point of view. This container or tank is additionally adapted to be matched by the use of a closure cover containing one or two valves on one or both chambers to different configurations of cooling systems, in which the chambers 2 and 3 are differently connected to the system pressure of the cooling system, to one another, and to the atmosphere. In every case, an air separation in the chamber 3 and therewith a complete venting of the chamber 2 is assured by the overflow line 13. The differing connection of the two chambers 2 and 3 with respect to one another is adapted to be determined exclusively by the selection of the closure covers on the openings 7 and 17.

Figure 4:
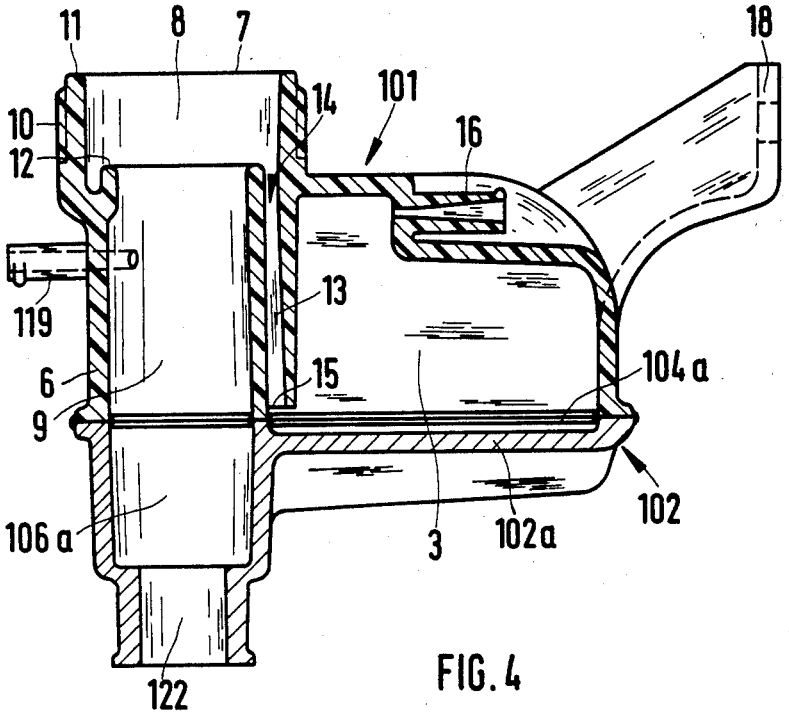
FIG. 4 is a cross-sectional view through a modified embodiment of a tank according to the present invention.

The construction of the container or tank generally designated by reference numeral 101 according to FIG. 4 includes a first upper molded part for the upper chamber 3 and the filler inlet 6 which is constructed corresponding to that according to FIGS. 1 to 3. Consequently, the same reference numerals are used in FIG. 4 designating similar parts. Additionally, the hose connecting nipple 119 for the connection of the end of the vent line from a high point of the cooling system is integrally molded. This connecting nipple 119 terminates in the inner section 9 of the filler inlet 6.

A lower bottom molded part generally designated by reference numeral 102 is secured in the lower separating plane 104' by welding, gluing or the like, which includes a bottom 120*a* reinforced with ribs, a connection 106*a* extending the inner section 9 of the filler inlet 6 in the downward direction and a hose connecting nipple 122 for the fill-in and return line to the suction side of the cooling medium pump, which continues the connection 106' with smaller cross section.

Also in the embodiment according to FIG. 4, the interior spaces of the molded parts up to the separating plane 104*a* as also the outsides and attachment parts can be molded in one piece by known molding techniques using appropriate molds. The exclusively two-partite construction with a simplified lower molded part offers a further reduced structural expenditure, but is versatile in its applications in a similar manner as the construction according to FIGS. 1 to 3.

According to FIG. 1, a filler inlet 6 made as separate plastic molded part may be secured in a sealed manner in an upper opening 206 of the second upper chamber 3, for example, by welding or gluing. As a result thereof, the molding of the filler inlet 6 will be facilitated without significant additional structural expenditures. Also, other attachment parts may be made separately as needed and may be connected with the chambers detachably or nondetachably without significantly impairing the advantages of the present invention.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A volume-expansion, venting and reservoir tank for the liquid-cooling system of internal combustion engines, comprising a first lower chamber means, a second upper chamber means, each chamber means being each made of a separate plastic molded part and connected together into an unitary tank, the two chamber means being connected together approximately horizontally, a filler inlet means connecting an upper fill-in opening with a lower continuation in the first lower chamber means and formed integrally with the second upper chamber means, an overflow line being formed integrally with the filler inlet means and terminating at one upper end in an externally enlarged section of the filler inlet means, and the overflow line terminating at its other lower end in the bottom area of the second upper chamber means.

2. A tank according to claim 1, wherein the first lower chamber means has the lower continuation of the filler inlet means with at least an approximately constant cross section and formed integrally with an approximately horizontally bottom part closing and secured to a lower opening of the second upper chamber means in an approximately horizontally separating plane.

3. A tank according to claim 1, wherein an upper opening of the first lower chamber means and a lower opening of the second upper chamber means are separated and connected together by an approximately horizontally arranged partition wall means, being made of a third separate plastic molded part and having an opening at which the fill inlet means is terminated and sealing connected.

4. A volume-expansion, venting and reservoir tank for the liquid-cooling system of internal combustion engines, comprising a lower first chamber means, a second upper chamber means, a partition wall means for separating the first chamber means from the second chamber means, the chambers and partition wall means being each made of a separate plastic molded part and connected together into a unitary tank, the partition wall means separating the two chamber means approximately horizontally and being provided with an opening which connects an upper fill-in opening with a lower continuation of the first lower chamber means by way of a filler inlet means which is attached with the second upper chamber means, an overflow line being formed integrally with the filler inlet means and terminating at one upper end in an externally enlarged section of the filler inlet means, and the overflow line terminating at its other lower end in the bottom area of the second upper chamber means.

5. A volume-expansion, venting and reservoir tank for the liquid cooling system of internal combustion engines, comprising a first lower chamber means, a second upper chamber means, a partition wall means for separating the first chamber means from the second chamber means, the chambers and partition wall means being each made of separate plastic molded parts and connected together into a unitary tank at an approximately horizontal separating plane, the first lower chamber means being constructed with a filler inlet means, the filler inlet means including an upper outwardly disposed enlarged section forming the fill-in opening, the filler inlet means connecting the inlet opening with a connections to a cooling medium pump located below the tank and being formed integrally with the second upper chamber means into a first molded part, an overflow line being formed integrally with the filler inlet means and terminating at one upper end in the upper enlarged section of the filler inlet means and at its other lower end terminating in the bottom area of the second chamber means, the first chamber means being formed as a second bottom molded part being connected at the separating plane with the filler inlet means and with the second chamber means and closing off the second chamber means.

6. A tank according to claim 5, wherein the filler inlet means is extended into the molded bottom part in an integrally molded connection with at least an approximately constant cross section.

7. A tank according to claim 6, wherein the integrally molded connection is extended with a smaller cross section.

8. A tank according to claim 6, wherein the integrally molded connection enlarges the filler inlet means in the downward direction at the first chamber means.

9. A tank according to claim 8, wherein the integrally molded connection forms the connection to the cooling medium pump.

10. A tank according to claim 8, wherein the inlet filler means together with the overflow line forms a separate plastic molded part and is secured in an upwardly disposed opening of the second chamber means.

11. A tank according to claim 4, wherein the inlet filler means together with the overflow line forms a separate plastic molded part and is secured in an upwardly disposed opening of the second chamber means.

12. A tank according to claim 5, wherein the inlet filler means together with the overflow line forms a separate plastic molded part and is secured in an upwardly disposed opening of the second chamber means.

13. A tank according to claim 12, wherein the filler inlet means is continued in the molded bottom part in an integrally molded connection with at least an approximately equal cross section.

* * * * *